United States Patent [19]

McCoy

[11] Patent Number: 4,539,781

[45] Date of Patent: Sep. 10, 1985

[54] DEVICE FOR TRANSPORTING LOADS BETWEEN VARIOUS ELEVATIONS

[76] Inventor: Leon A. McCoy, 1817 N. Chester St., Baltimore, Md. 21213

[21] Appl. No.: 539,000

[22] Filed: Oct. 4, 1983

[51] Int. Cl.[3] ..... E04F 11/00

[52] U.S. Cl. ..... 52/183; 52/10; 182/26; 182/49

[58] Field of Search ..... 52/183, 9, 10; 182/49, 182/1, 20; 272/2, 27 R, 1 R, 6

[56] References Cited

U.S. PATENT DOCUMENTS

| | | | |
|---|---|---|---|
| 914,805 | 3/1909 | Cross | 272/2 |
| 1,944,159 | 1/1934 | Bailey | 182/1 |
| 2,576,556 | 11/1951 | Babson | 52/183 |
| 2,740,165 | 4/1956 | Ward | 52/183 |
| 2,812,528 | 11/1957 | Odell | 52/183 |

FOREIGN PATENT DOCUMENTS

| | | | |
|---|---|---|---|
| 333146 | 2/1921 | Austria | 272/1 R |
| 33475 | 8/1981 | European Pat. Off. | 182/1 |

*Primary Examiner*—Henry E. Raduazo
*Attorney, Agent, or Firm*—Walter G. Finch

[57] ABSTRACT

The invention is an improved device for transporting loads between various elevations. Such loads may be handicapped persons in wheelchairs, wheeled truck loads of freight or materials, wheeled people carriers, or other similar loads that require transport from one elevation to another, either ascending or descending. The improved device serves a double mission as a regular stairway facility for ambulatory persons, and as a ramp-type facility for wheeled vehicles carrying a person, or persons, or a load of freight or materials, and other such loads as may require movement from one elevation to another elevation. The improved device for transporting loads between various elevations consists of: a plurality of stairway treads; a plurality of stairway risers; said plurality of stairway treads and plurality of stairway risers being suitably hinged together in alternating sequence so as to be capable of expansion into a ramp-like surface; a plurality of guide slots to control movement of said hinged plurality of stairway treads and stairway risers when moving from a stairway configuration to a ramp-like configuration or the reverse thereof; a plurality of hinge pin-like extensions to connect the hinges, between each stairway tread and each stairway riser, to said plurality of guide slots; a contact member to temporarily affix to a loaded vehicle to be moved; a power means to operate a mechanism to change the stairway configuration to a ramp-like configuration or the reverse; and a power means to operate a mechanism to move the contact member to move said loaded vehicle.

11 Claims, 8 Drawing Figures

DEVICE FOR TRANSPORTING LOADS BETWEEN VARIOUS ELEVATIONS

BACKGROUND AND SUMMARY OF THE INVENTION

The invention is an improved device for transporting loads between various elevations and in particular to transporting handicapped persons in wheelchairs. Specifically, it relates to an improved device that serves a dual mission, first as a regular stairway facility for ambulatory persons, and second as a ramp-like or ramp-type facility for wheeled vehicles carrying a person or persons, or a load of freight or materials, or other similar loads. The combination stairway and ramp facility being the means by which the aforementioned loads may be moved from the level of one elevation to the level of another elevation.

Such loads in wheeled vehicles might be handicapped persons in wheelchairs, groups of people in wheeled people carriers, packaged freight or materials in wheeled truck means, or other similar loads in suitable wheeled vehicles.

The movement of such loads from one elevation to another elevation may be either an ascending movement or a descending movement.

Devices for moving the aforementioned loads between various elevations in the prior art usually consisted of elevators running vertically in a shaft-like enclosure between the various elevations or the equivalent of such vertical elevators running openly or within some restriction that might be termed an inclined elevator means. The prior art elevators running in vertical shaft-like enclosures are well known. Except for the ordinary escalator, or moving stairway, the prior art inclined elevator means are not as well known.

Some of the prior art inclined elevator means are: an inclined elevator means mounted on and along the protruding edges or nose of the treads of a stairway to one side of the stairway walking area, providing a seat or platform on which a person sits or stands while being moved; a construction type elevator having a framework set at an incline between a ground level elevation and some higher elevation, such as a roof and having a box-like corner for transporting a load from one level to the other; and an inclined set of tracks on and to which a horizontal platform is moveably affixed to ride along the tracks as a load on the horizontal platform is moved from one elevation to another by motive power means. None of these concepts of the prior art provide the novel and unique structure of the present invention for moving wheeled loads from one elevation to another.

Other prior art devices for moving wheelchairs from one elevation to another elevation are described hereinafter, usually described as stair-climbing wheelchairs.

Such stair-climbing wheelchairs consist of wheelchairs having various means affixed thereto to propel the wheelchair up the series of steps, some of which are: a tri-set of wheels rotatably at the back of the chair and a cross-type structure of small rollers at the front of the wheelchair which together drive the combination to climb the stairway; a track-like device affixed at the bottom of a wheelchair which crawls up the stairway; a set of four wheels on vertically movable supports on each side of a wheelchair with the four wheels on each side operating to individually, as a left and right pair, mount the stairs in turn while maintaining the wheelchair level; a similar device to the latter with three pairs of driving wheels on each side of the wheelchair; a track-type device which lays the track on individual treads of a stairway one after the other; and a plurality of wheels in a star-like configuration inside of a track-means that crawls up a stairway step by step.

None of the so-called stair-climbing wheelchairs of the prior art provides the novel and unique structure of the present invention for safely moving a wheelchair or other type of wheeled vehicle, as described hereinafter, from one elevation to another elevation.

The improved device of the present invention consists of a plurality of stairway treads and a plurality of stairway risers set in a first configuration of an ordinary stairway which may be used by ambulatory persons. In a second configuration the plurality of treads and the plurality of risers are stretched out, as hereinafter described, to form a straight ramp-like means up or down which wheeled vehicles, as hereinbefore described, may be moved from one elevation to another elevation.

The plurality of stairway treads and the plurality of stairway risers are suitably hinged together so that they may be stretched out into the aforementioned ramp-like means. The plurality of hinge means are each located so as to hinge the bottom or lower horizontal edge of each riser to the back or inside the horizontal edge of each riser; and the top or upper horizontal edge of each riser to the front or nose of each tread; thus providing the basic ramp-like surface when stretched out.

The top horizontal edge of the uppermost riser is similarly hinged to the horizontal front or nose of the upper landing or platform of the stairway. The bottom horizontal edge of the lowermost riser is arranged to feather-edge with the lower landing or floor when stretched into the said ramp-like configuration.

At each side of each hinge of the plurality of hinges a hinge pin-like extension protrudes beyond the sides of each riser and tread hinged combination. These hinge pin-like extensions slidably fit into slots, described hereinafter, for support of the risers and treads and for control of the movement of the combination of hinged risers and treads when changing from a stairway configuration to a ramp-like configuration or when reversing that movement.

A plurality of slots at each side of the stairway are provided in the stairway side enclosure means. The hinge pin-like extensions extend into and slidably fit in the respective slots at each hinge pin-like extension location.

The aforementioned slots provide the control of movement of the hinge pin-like extensions when the stairway configuration is changed to a ramp-like configuration or a reverse movement is made. The control of movement includes controlling the direction of movement as described hereinafter.

The aforementioned slots are so located and configured so that as the hinge pin-like extensions slidably move therein, the risers and treads are brought into the ramp-like configuration.

The slot for each hinge pin-like extension at the nose of each tread is straight and horizontal, thus the nose of the tread moves forward in a straight line. The slot for each hinge pin-like extension at the bottom of each riser rises in a gentle forward arc-like curve upwardly.

Thus, when moving into a ramp-like configuration, the nose of each tread, with the top of the adjacent riser hinged to it, moves horizontally straight outwardly to a point where the hinged joint will lie in the plane of the ramp-like surface.

Concurrently, the bottom of each riser, with the rear edge of the adjacent tread hinged to it, moves in the gentle arc of the slot to a point where this hinged joint will also lie in the plane of the ramp-like surface.

When the movement is reversed the hinge pin-like extensions follow the control slots to their original position to return the ramp-like configuration to that of a stairway.

At the lower elevation of the dual use device, as a stairway configuration and as a ramp-like configuration, a contact member is provided which is temporarily and removably affixed to the load vehicle to be elevated. The contact member is suitably hinged at one end thereof so that it can be raised to provide access to the stairway of the stairway configuration when a person desires to walk up or down the stairs.

Two power means and associated mechanisms are provided as part of the structure of the invention. A first power means is connected to a mechanism that changes the stairway configuration to a ramp-like configuration, and to reverse the operation. A second power means operates the contact member, after it is temporarily and removably affixed to the load vehicle, so as to push the load vehicle up the ramp-like surface from the lower elevation to the upper elevation; the contact member when reversed will lead the load vehicle or permit the load vehicle to move down the ramp-like surface by gravity.

It is, therefore, an object of this invention to provide a device to move wheeled vehicles from one elevation to another elevation.

It is another object of this invention to provide a device to move wheeled vehicles from one elevation to another elevation that may be operated in a stairway configuration or in a ramp-like configuration.

It is also an object of this invention to provide a device to move wheeled vehicles from one elevation to another elevation wherein the wheeled vehicle is a wheelchair.

It is still another object of this invention to provide a device to move wheeled vehicles from one elevation to another elevation wherein the wheeled vehicle is a people carrier.

It is yet another object of this invention to provide a device to move wheeled vehicles from one elevation to another elevation wherein the wheeled vehicle is a cargo carrier.

It is yet a further object of this invention to provide a device to move wheeled vehicles from one elevation to another elevation that will move the wheeled vehicles loaded or unloaded in an ascending or descending mode between elevations.

Further objects and advantages of the invention will become more apparent in light of the following description of the preferred embodiments.

DESCRIPTION OF THE PREFERRED EMBODIMENTS

Figure 1:
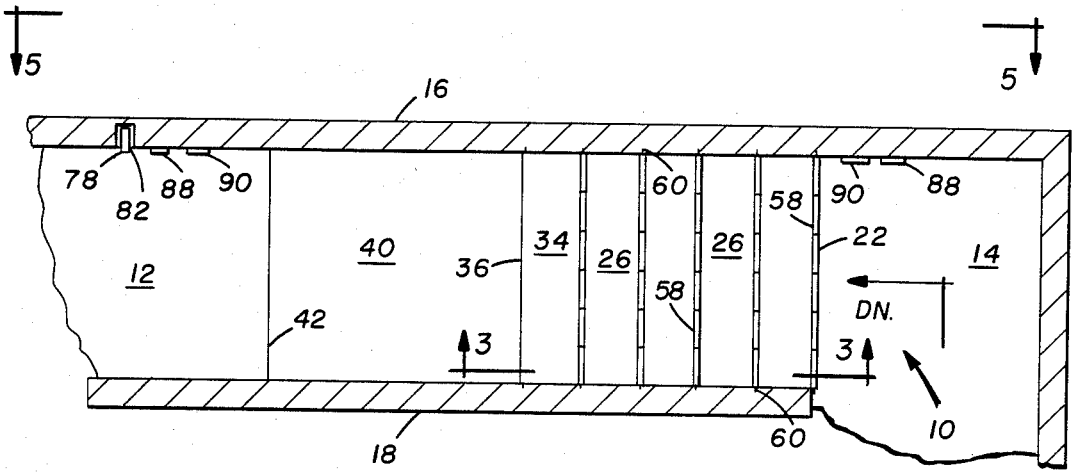
FIG. 1 is a partial cross-section of a plan view of a device for transporting loads between various elevations, shown in a stairway configuration.

Referring now to the drawings and particularly to FIGS. 1, 2, 3, and 4, a device for transporting loads between various elevations is shown at 10.

Figure 2:
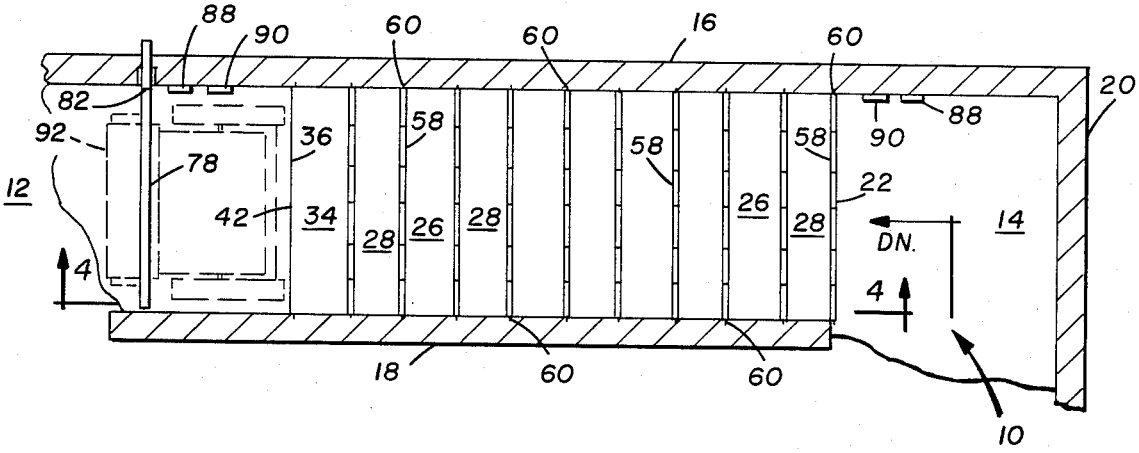
FIG. 2 is a partial cross-section of the device of FIG. 1, shown in a ramp-like elevation.
Figure 3:
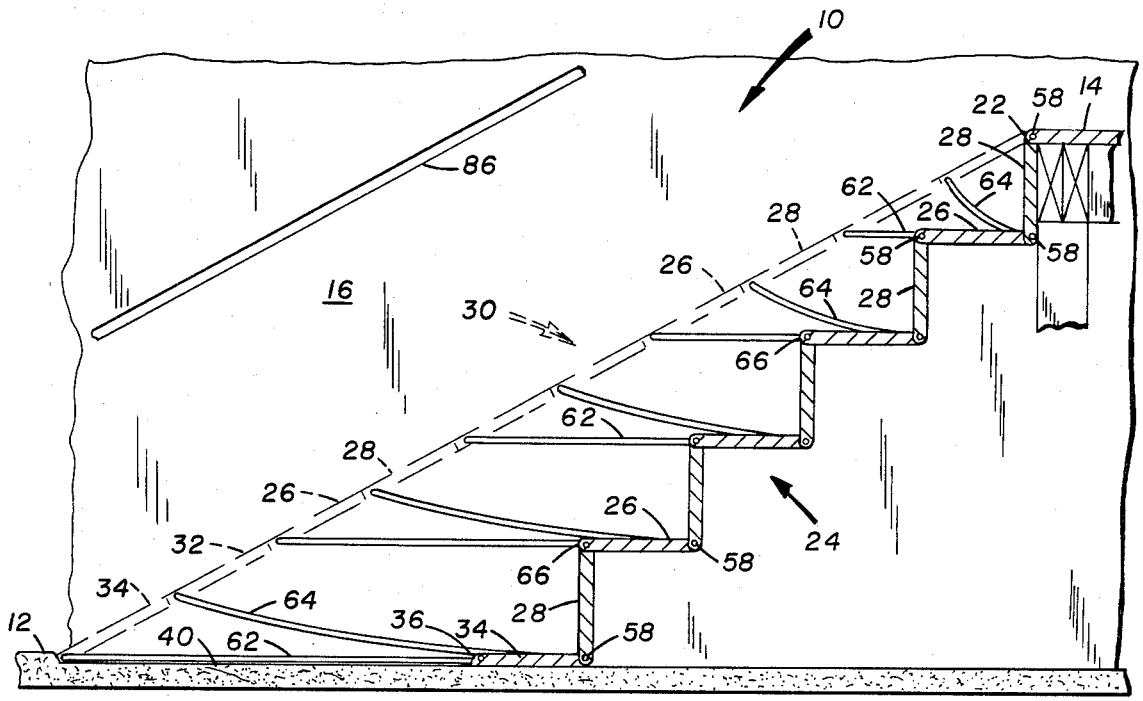
FIG. 3 is an enlarged cross-sectional view taken on line 3—3 of FIG. 1.
Figure 4:
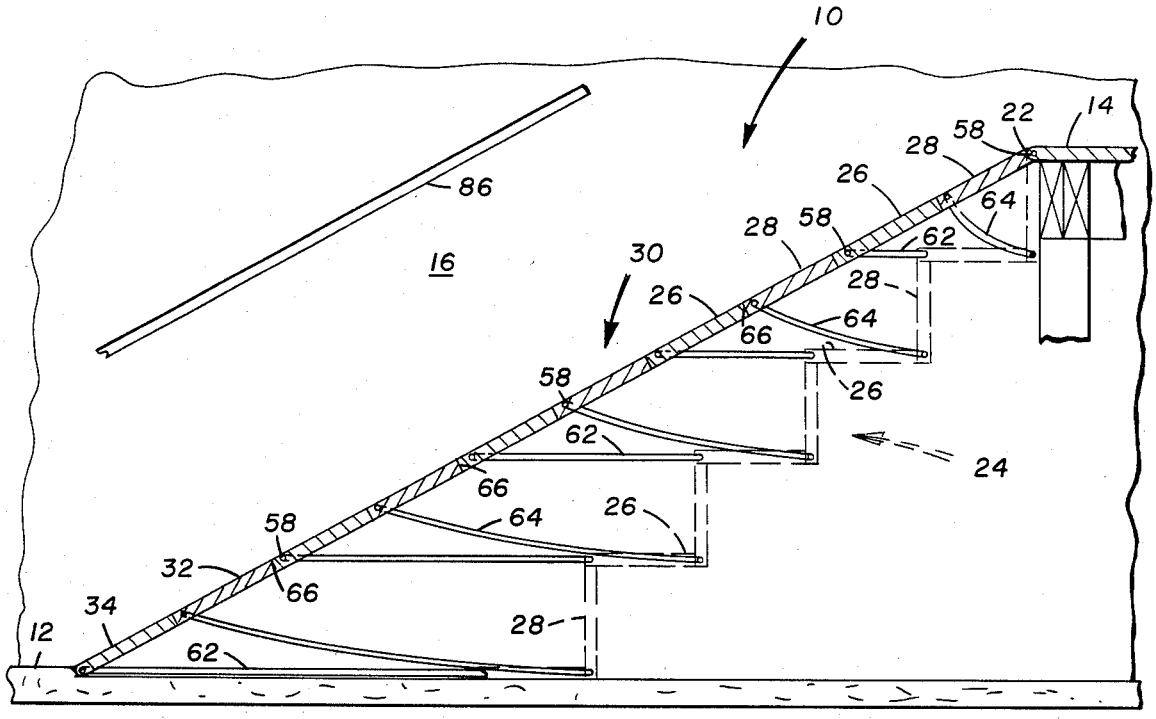
FIG. 4 is an enlarged cross-sectional view taken on line 4—4 of FIG. 2.

The device for transporting loads 10 between various elevations is shown in a stairway configuration in FIGS. 1 and 3 and in a ramp-like configuration in FIGS. 2 and 4.

The stairway configuration in FIGS. 1 and 3, described in detail hereinafter, provide a means for ambulatory persons individually, or carrying light loads, to ascent the stairway configuration from a lower elevation 12 to an upper elevation 14, or to descend from an upper elevation 14 to a lower elevation 12.

The ramp-like configuration in FIGS. 2 and 4, described in detail hereinafter, provide a means for transporting loads in wheeled vehicles over the ramp-like configuration from a lower elevation 12 to an upper elevation 14, or from an upper elevation 14 to a lower elevation 12.

The lower elevation 12 and the upper elevation 13 may be of such structure as the floors in a building.

The device for transporting loads 10 between various elevations is suitably enclosed at the sides 16 and 18. Such enclosure sides 16 and 18 may be walls of the general structure in which the device for transporting loads 10 between the afore-mentioned elevations.

Where the enclosed sides 16 and 18 are walls of the general structure, the mechanisms, described in detail hereinafter, are suitably located within such walls. Where the enclosed sides 16 and 18 are mechanism enclosures of the device for transporting loads 10, the enclosured sides 16 and 18 serve a safety purpose to prevent persons or loads falling from the sides. In the latter case the enclosured sides 16 and 18 may be configured similar to low banister walls such as enclose free-standing or open stairways.

A partition or exterior wall 20 is shown at elevation 14 for illustration. However, it is to be understood that the location of the device for transporting loads 10 will determine the relative relationship of other walls or objects. The upper edge 22 of the device for transporting loads 10 should have adequate clearance from any wall 20 so that loads on wheeled vehicles, described hereinbefore and further described hereinafter, may have sufficient space in which to maneuver upon arriving at the upper level 14, or for maneuvering prior to descending to the lower level 12. Thus the upper edge 22 should be adequately spaced from any wall 22 or other similar object of the general structure.

FIGS. 1 and 3 show the device for transporting loads 10 in a stairway configuration. The stairway configuration 24 has a plurality of treads 26 and a plurality of risers 28.

FIGS. 2 and 4 show the device for transporting loads 10 in a ramp-like configuration 30. The plurality of treads 26 and the plurality of risers 28 of the stairway configuration 24 are now in line in the plane of the surface of the ramp-like configuration 30. Thus, the treads 26 and the risers 28 alternate in the plane of ramp-like surface 30.

In FIG. 3 showing the stairway configuration 24, the ramp-like configuration 30 is shown in phantom lines for treads 26 and risers 28.

In FIG. 4 showing the ramp-like configuration 30, the stairway configuration 24 is shown in phantom lines for treads 26 and risers 28.

The manner in which the plurality of treads 26 and the plurality of risers 28 is moved from the stairway configuration 24 to the ramp-like configuration 30 is described hereinafter. However, it will be noted in FIG. 4 that at the bottom of the ramp-like configuration 30 at the elevation 12 that the bottom or lowest riser 28 of the stairway configuration 24 is placed in a position 32. This requires a filler tread 34 to complete the ramp-like configuration 30. The filler tread 34 is shown in the stairway configuration 24 in FIG. 3.

Figure 6:
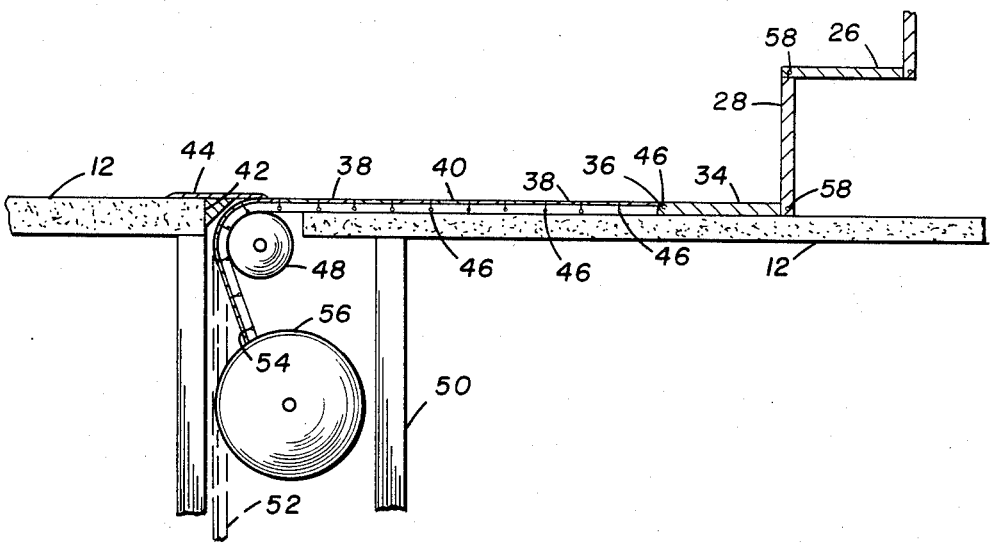
FIG. 6 is an enlarged partial cross-sectional view showing a second embodiment of a portion of FIG. 1.

To prevent the leading edge or nose 36 of the filler tread 34 from presenting a safety hazard, the leading edge or nose 36 may be tapered or provided with a feather edge. However, a preferred second embodiment is to suitably affix the leading edge or nose 36 to a plurality of narrow slat-like members 38 which has a top surface that is in the same plane as the elevation 12. The arrangement and operation of these narrow slat-like members 38 is described hereinafter and is shown in FIG. 6.

When the filler tread 34 with the tapered or feathered edge 36 is used, provision must be made for a depressed area 40, within the area of the lower elevation 12, within which the filler tread 34 moves when the airway configuration 24 is extended into a ramp-like configuration 30.

The end 42 of the depressed area 40 is spaced from the tapered or feathered edge 36 when the device for transporting loads 10 is in the stairway configuration 24, as shown in FIG. 1. When the device for transporting loads 10 is in the ramp-like configuration 30 the tapered or feather edge 36 interfaces with and coincides with the end 42 of the depressed area 40 as shown in FIG. 2.

It is to be noted that the depressed area 40 is within the confines of the enclosed sides 16 and 18. This provides a measure of safety where end 42 of the depressed area 40 must also be tapered or given a feathered edge to prevent exposure to a safety hazard when the device for transporting loads 10 is in either the stairway configuration 24 or the ramp-like configuration 30.

In the second embodiment for the lower end of the ramp-like configuration 30, using the plurality of narrow slat-like members 38, shown in FIG. 6, the narrow slat-like members 38 are situated within the depressed area 40 so that the top surface of the filler tread 34, the top surface of the plurality of narrow slat-like members 38, and the top surface of elevation 12 are substantially in the same horizontal plane.

A transition plate 44 with feathered edges provides the means whereby the narrow slat-like members 38 are moved away as the nose 36 of the filler tread 34 moves into its bottom position as part of the ramp-like configuration 30. It is to be noted that in this second embodiment the nose 36 shown in FIG. 6 is not tapered or feathered as in the first embodiment shown in FIG. 1, but is so constructed so that the top surface of the filler tread 34 is flush with, and adjacent to, the top surface of the first of the narrow slat-like members 38.

When the stairway configuration 24 is moved and converted into a ramp-like configuration 30, the plurality of narrow slat-like members 38, hingedly 46 affixed to each other and hingedly 46 affixed to the leading edge or nose 36 of the filler tread 34, all move toward the end 42 of the depressed area 40. The narrow slat-like members 38 each, in turn, pass under the transition plate 44 and then downwardly. The narrow slat-like members 38 may be stored temporarily in numerous ways after passing under the transition plate 44 and then downwardly, all of which are within the scope and intent of this invention.

The narrow slat-like members 38, after passing under the transition plate 44, move over a drum-like roller 48 and then downwardly. The plurality of narrow slat-like members 38 may be permitted to hang straight downwardly within a slot at enclosure 50, as shown in phantom lines 52, or the distal end narrow slot-like member 54 may be affixed to a reel-like device 56. Other means of temporarily storing the plurality of narrow slat-like members 38 may be used and such variations are within the scope and intent of this invention.

Figure 7:
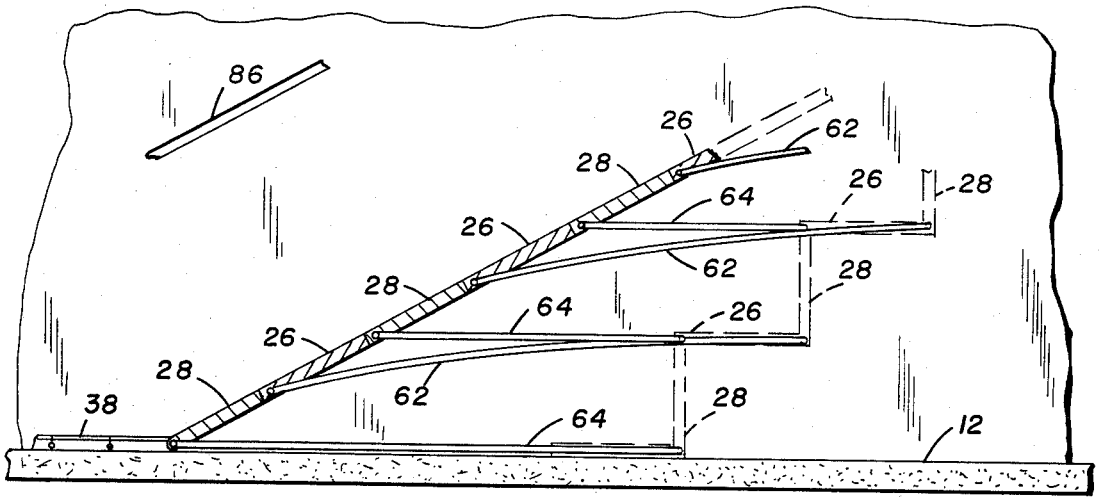
FIG. 7 is an enlarged cross-sectional view of a third embodiment of FIG. 2.

It is to be understood that to have the lowermost transverse edge of the bottom riser 28 move straight outwardly in a horizontal direction to the lowermost point of the ramp-like configuration 30, thus establishing a slightly steeper ramp configuration 30, and eliminating the filler tread 34, is within the scope and intent of this invention. In such a structure the narrow slat-like members 38 are hingedly affixed to the lowermost transverse edge of the bottom riser 28 in a manner similar to the manner in which the slat-like members 38 were hingedly affixed to the leading edge or nose 36 of the filler tread 34 as shown in FIG. 7.

It is also to be understood that as a further variation, the lowermost transverse edge of the bottom riser 28 may be moved horizontally paralled with the plane of the elevation 12 without resort to the use of a depressed area 40 and the narrow slat-like members 38. In this latter arrangement, the lowermost transverse edge of the bottom riser 28 is tapered to a feather edge on the so called inside of the riser 28 so as to provide an easy transition from the elevation 12 to the ramp-like configuration 30.

It is to be noted that in FIGS. 1, 2, 3, 4, and 5, five risers 28 and four treads 26, exclusive of the filler tread 34 and upper landing of elevation 14, are shown for illustration of the device for transporting loads 10. It is to be understood that the range of the plurality of treads 26 and risers 28 is unlimited in order to match and facilitate difference in elevations between the lower elevation 12 and the upper elevation 14. Such an unlimited range in the plurality of treads 26 and risers 28 is within scope and intent of this invention.

The treads 26 and risers 28 are hingedly 58 affixed to each other. The uppermost riser 28 is similarly hingedly 58 affixed to the elevation 14 landing at the upper edge 22 of the device for transporting loads 10, and to the filler tread 34 or to the narrow slat-like members 38 when so structured.

The hinges 46 and 58 may be piano-type hinges or other similar hinges providing a positive in-line hinged joint that parallel each other in the plurality of hinged joints for positive movement.

The hinges 46 and 58 have extended hinge pins 60 that fit into, are controlled and guided by, and are supported by and within slots 62 and 64. Slots 62 are for the extended hinge pins 60 of and to guide, control, and support the treads 26 when moving from a stairway configuration 24 to a ramp-like configuration 30. Slots 64 are for the extended hinge pins 60 of and to guide, control, and support the risers 28. The extended hinge pins 60 are integral and monolithic with the hinge pin portions within the hinges 46 and 58 and extend outwardly on both sides of the hinges 46 and 58.

The slots 62 are horizontally straight and level in order to guide the nose 66 of each tread to its position in the plane of the ramp-like configuration 30. The slots 64 are in an upturned arc-like configuration which follows the path taken by the extended hinge pins 60 of the risers 28 as they extend and rise concurrently in order to bring the juncture of the lowermost point of each riser 28 with the rearmost point of each tread to its position in the plane of the ramp-like configuration 30.

Note that the upper edge 22 of the device for transporting loads 10 is essentially the nose of the landing or upper level 14 and is similar to the nose 66 of each tread 26, but the upper edge 22 is stationary.

At the bottom of the ramp-like configuration 30 at the elevation 12, the extended hinge pin 60 of the hinge 46 at the forward end of the filler tread 34 follows a similar horizontally straight and level slot 62. This is also the case when the narrow slat-like members 38 are part of the embodiment. If the alternative embodiment is used the lowermost transverse edge of the lowermost or bottom riser 28 is moved horizontally with the plane of the elevation 12, without resort to the use of a depressed area 40 and the slat-like members 38, the lowermost transverse edge of the bottom riser 38 moves in a horizontally straight slot 62, instead of an upturned slot 64. This latter embodiment variation then gives all the other slots 62 and 64 a slightly shorter length as the plane of the ramp-like configuration 30 is at a slightly steeper angle with the elevation 12.

Figure 8:
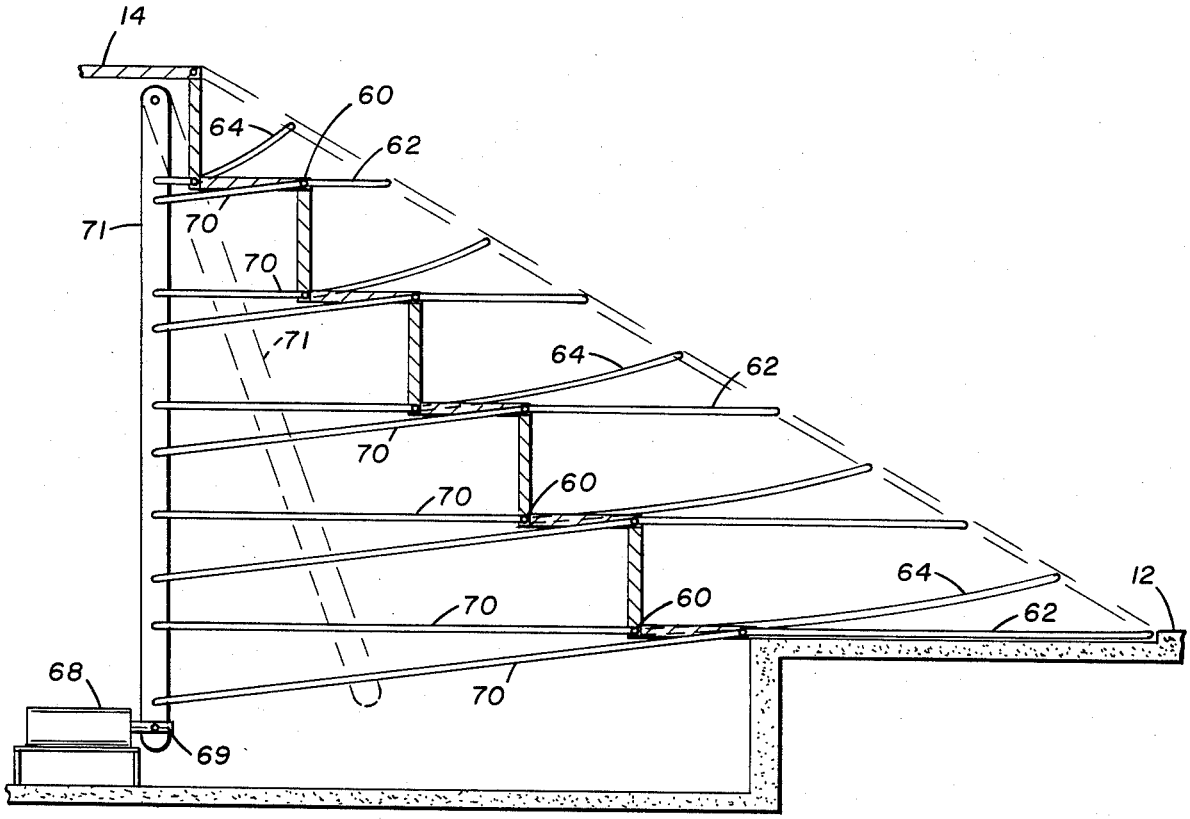
FIG. 8 is a mechanism for converting the device for transporting loads in FIG. 1 to the device for transporting loads in FIG. 2 and vice versa.

The movement of the extended hinge pins 60 in the respective slots 62 and 64 is by a power means 68 as shown in FIG. 8. The power means 68 transfers or transmits motion to the respective extended hinge pins 60 by a plurality of push-pull rods 70. Note that the length of slots 62 and 64 are each progressively longer in length from the top of the stairway configuration 24, or ramp-like configuration 30, at elevation 14, to the bottom of the stairway configuration 24, or ramp-like configuration 30. Note, also, that the slots 62 and 64 are on each side of the device for transporting loads 10.

The plurality of push-pull rods 70 are progressively longer to match the progressively longer distances that the extended hinge pins 60 must move in the progressively longer slots 62 and 64, respectively, from top to bottom as hereinbefore described, when converting from a stairway configuration 24 to a ramp-like configuration 30, reversing the movement. The plurality of push-pull rods 70 are suitably connected to a common motion lever 71 which in term is suitably connected by a power transmission means 69 to the power means 68.

To assure an even movement in the aforementioned conversion from the stairway configuration 24 to the ramp-like configuration 30, the plurality push-pull rods 70 are provided on both sides of the device for transporting loads 10. It is to be understood, however, that to provide the plurality of push-pull rods 70 on one side only, or by a connection means at the center point, transversely, of each tread 26 and riser 28 in the vicinity of the transverse center point of the hinges 58, is within the scope and intent of this invention.

It is also to be understood, that alternative means for moving the extended hinge pins 60 in the slots 62 and 64, respectively, such as by a solid side plate, pair of side plates, or a center plate, is within the scope and intent of this invention.

Likewise, it is also to be understood that other alternative means for moving the extended hinge pins 60 in the slots 62 and 64, respectively, such as by a train of gears, a plurality of racks and pinions, or by other similar or or equivalent means, so as to move the extended hinge pins 60 within their respective slots 62 and 64, in both timed and dimensional movement, in converting the device for transporting loads from one mode to another mode of configuration, is within the scope and intent of this invention.

In that regard, it is also within the scope and intent of this invention to provide a plurality of power means, instead of a single power means, to provide a synchronized timed and dimentional movement for each tread 26 and riser 28 in connecting the device for transporting loads 10 to the several modes described hereinbefore.

The various alternative power means, described hereinbefore, for converting the device for transporting loads 10 from one mode to another mode are somewhat optional, the primary portion of the invention lying in the mechanism of the detailed description of the stairway configuration 24 and the ramp-like configuration 30, and in the means for moving the aforementioned wheeled loads up the ramp-like configuration 30 as will be described hereinafter.

Figure 5:
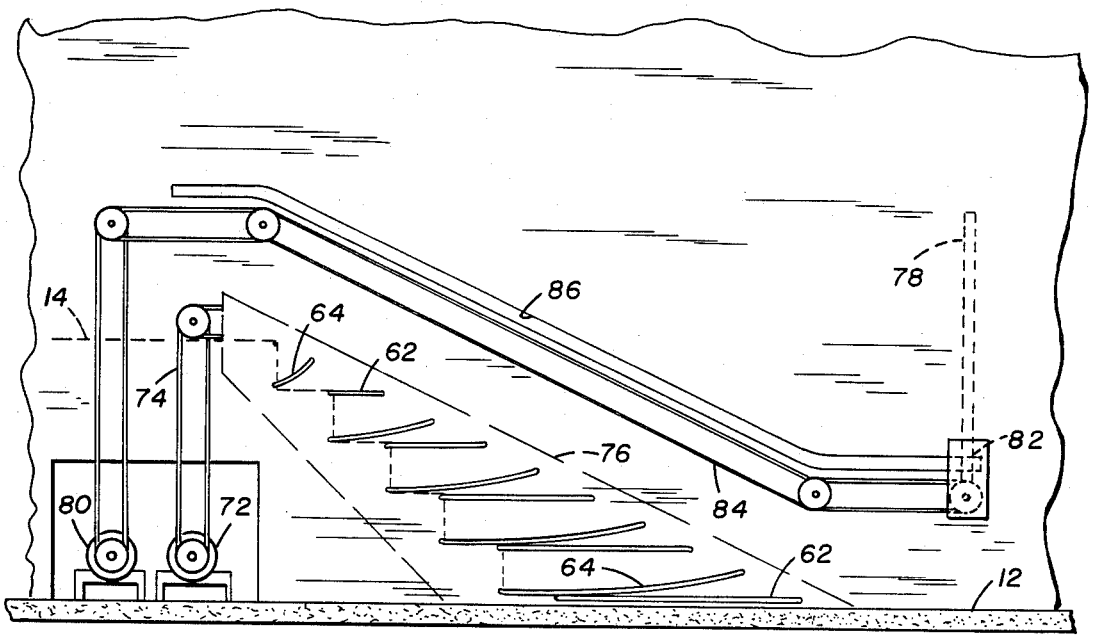
FIG. 5 is a cross-sectional view taken on line 5—5 of FIG. 1.

One simulation of the alternative power means for the conversions is shown in FIG. 5. In FIG. 5 a power source 72 is mechanically transmitted or connected 74 to the alternative mechanism 76 which is shown schematically.

Regarding the stairway configuration 24 and the ramp-like configuration 30, there are three variations or embodiments. FIGS. 1 and 2 show the first embodiment, FIG. 6 shows the second embodiment which modifies the structure of the first embodiment at the elevation 12 level, and FIG. 7, shows the third embodiment which modifies the structure of the first embodiment at the elevation 12 level and also modifies the angle of the ramp-like configuration 30 in relation to the elevations 12 and 14.

The manner in which a wheeled load is moved up or down the ramp-like configuration 30 is by mean of a load push bar 78. The load movement bar 78 removably interfaces with a suitable contact means on the wheeled load and upon operation of the power means 80 pushes the wheeled load up the ramp of the ramp-like configuration 30. In reverse, the movement bar 78 serves as a restraining means to lead the wheeled vehicle down the ramp of the ramp-like configuration 30, the wheeled vehicle actually descending the ramp by gravity.

When the wheeled vehicle is a wheelchair 92, the wheelchair 92 is moved upon down the ramp with the person in the wheelchair facing down the ramp as the preferred method. However, it is to be understood that the wheelchair 92 may be moved up or down the ramp with the person in the wheelchair facing up the ramp, and such a variation is within the scope and intent of the invention.

The wheeled vehicles may be temporarily latched to the wheeled vehicle at the contact means thereon. Such a variation is also within the scope and intent of the invention.

The movement bar 78 is lock-hinged 82 at the side where it is affixed to the mechanism 84 of the power means 80. The lock-hinge 82 permits release and raising the movement bar 78 at the lower level elevation 12 to permit movement of a wheeled vehicle into position for movement up the ramp, or for movement of a wheeled vehicle away from the ramp which has descended the ramp; and at the upper level elevation 14 it permits release and raising the movement bar 78 when the stairway configuration 24 is to be used by ambulatory persons. The lock hinge 82 provides a desirable safety factor.

The movement bar 78, suitably affixed to the mechanism 84 inside the enclosed side 16, moves in a slotlike opening 86 in the enclosed side 16. The slot-like opening 86 parallels the plane of the ramp.

Controls 88 for operation of the power means 68 are located at the elevations 12 and 14. The controls are located conveniently for the person moving the wheeled vehicle or for the person in the wheelchair.

Regarding the power means 80 and the mechanism 84 associated with it, it is to be understood that the mechanism 84 may be belt driven, chain driven, or by any other similar or equivalent means, and that these variations are within the scope and intent of the invention.

As can be readily understood from the foregoing description of the invention, the present structure can be configured in different modes to provide the ability to change a stairway configuration into a ramp-like configuration for moving wheeled vehicles up or down the ramp between several elevations.

Accordingly, modifications and variations to which the invention is susceptible may be practiced without departing from the scope and intent of the appended claims.

What is claimed is:

1. A device for transporting loads between various elevations, comprising:

a stairway means;

said stairway means consists of a plurality of tread members, a plurality of riser members, and a plurality of hinge means, said stairway means extending from a first elevation to a second elevation, each hinge means of said plurality of hinge means in turn transversely hingedly affixing one of said tread members to one of said riser members, said transverse hinged affixation being provided alternately between the juncture of the lowermost transverse edge of each said riser member and the rearmost transverse edge of the adjacent said tread member, and between the juncture of the forwardmost transverse edge of each said tread member and the uppermost transverse edge of each said riser member, and between the uppermost transverse edge of the topmost riser member of said stairway means and said second elevation, the lowermost distal end of said stairway means being suitably affixed at said first elevation, and a mechanism means, said mechanism means being capable of converting said stairway means into a ramp means, said ramp means having a ramp-like configuration.

2. A device for transporting loads between various elevations as recited in claim 1, wherein said stairway means may be used as a stairway for ambulatory persons.

3. A device for transporting loads between various elevations as recited in claim 1, wherein said ramp means may be used for wheeled loads when in said ramp-like configuration.

4. A device for transporting loads between various elevations as recited in claim 3, wherein said wheeled loads may be persons in wheelchairs, a plurality of people in wheeled people carriers, and cargo in wheeled freight trucks.

5. A device for transporting loads between various elevations as recited in claim 1, and additionally a plurality of hinge pin extensions, said plurality of hinge pin extensions being integral and monolithic extensions of each hinge pin in said plurality of hinge means, said hinge pin extensions being on each end of each said hinge pin so as to protrude from both ends of said hinge means.

6. A device for transporting loads between various elevations as recited in claim 5, wherein said mechanism means consist of a plurality of slots, a power source, a power transmission means, and a housing means, each said hinge pin extension being suitably located within and supported by a respective slot of said plurality of slots equally situated on each side of said stairway means, said mechanism means being suitably enclosed in said housing means, said power transmission means transmitting motion from said power source to said plurality of hinge pin extensions in said plurality of slots, said mechanism means thereby converting said stairway means into said ramp means.

7. A device for transporting loads between various elevations as recited in claim 6, wherein said plurality of slots are configured in pairs of two different modes of progressively longer lengths, said two different modes of slots being progressively longer with the shortest slots being adjacent to said second elevation and the longest slots being at said first elevation, each pair of slots supporting a pair of said hinge pin extensions of each said hinge means located at said juncture of said forwardmost transverse edge of each said tread member and the uppermost transverse edge of each said adjacent riser member being configured in a horizontally straight slot mode, each pair of slots supporting a pair of said hinge pin extensions of each said hinge means located at said juncture of said lowermost transverse edge of each said riser member and the rearmost transverse edge of the adjacent said tread member being configured in an upturned arc-like slot mode, said plurality of slots serving to support, guide, and control the movement of said hinge pin extensions when said motion is transmitted to said plurality of hinge pin extensions by said power source through said power transmission means, said configuration of said progressively longer slots guiding said hinge pin extension means to a position so that said plurality of tread members and riser members in line forms said ramp in a single plane.

8. A device for transporting loads between various elevations as recited in claim 7 and additionally, a load movement means, said load movement means being for the purpose of moving a load up said ramp from said first elevation to said second elevation and for controlling the descent of a load from said second elevation to said first elevation, said load movement means consists of a load power means, a load motion transmission mechanism means, a load contact connection means, and a load contact slot means, said load contact connection means having a lock-type hinge means thereon, said lock-type hinge means facilitating the movement of said load contact connection means from a clearance position to a load contact position and providing a means for locking said lock-type hinge means in said two positions, said load contact slot means being located in said housing means, said load contact connection means projecting through said load contact slot means and being affixed to said load motion transmission means, said load transmission means receiving motion from said load power means to move said loads up and down said ramp.

9. A device for transporting loads between various elevations as recited in claim 8 and additionally control means, said control means being located at said first elevation and said second elevation convenient to the first and second elevation ends of said device for transporting loads between elevations, one of said controls operating said power source of said mechanism means converting said stairway means into said ramp, and the other of said control means operating said load power means to move loads on said ramp.

10. A device for transporting loads between various elevations as recited in claim 7 and additionally, a filler tread member, and a depressed floor area, said filler tread member being suitably hinged at the rear transverse edge thereof to the lowermost transverse edge of the lowermost riser member, said filler tread member being equipped with hinge pin extensions and provided with slot means for said hinge pin extensions in a manner similar to other said tread members, said filler tread member being located at said first elevation and providing for extra length for said ramp at a lesser angle to the horizontal said first elevation, said filler tread member moving within said depressed floor area in said first elevation.

11. A device for transporting loads between various elevations as recited in claim 10 and additionally, a plurality of narrow slat-like members, a plurality of hinge means, a drum-like roller means, a reel-like device, a transition plate, and an enclosure means, each hinge means of said plurality of hinge means hingedly affixing a narrow slat-like member of said plurality of narrow slat-like members to an adjacent slat member, a first narrow slat-like member of said hingedly affixed plurality of narrow slat-like members being hingedly affixed with one of said hinge means to the unhinged transverse edge of said filler tread, said narrow slat-like members fitting into and moving in said depressed floor area, said hingedly affixed plurality of slat-like members moving from said depressed floor area into said enclosure means over said drum-like roller means therein, thereafter the most distal narrow slat-like member of the plurality of narrow slat-like members is hingedly affixed to said reel-like device, said transition plate covering the point where said plurality of narrow slat-like members move from said depressed floor area into said enclosure means.

* * * * *